US011754377B1

(12) United States Patent
Holloway

(10) Patent No.: US 11,754,377 B1
(45) Date of Patent: Sep. 12, 2023

(54) APPARATUS FOR SHIELDING A STRUCTURE FROM BULLETS AND METHOD OF USE

(71) Applicant: Graham Holloway, Santa Maria, CA (US)

(72) Inventor: Graham Holloway, Santa Maria, CA (US)

( * ) Notice: Subject to any disclaimer, the term of this patent is extended or adjusted under 35 U.S.C. 154(b) by 149 days.

(21) Appl. No.: 17/394,924

(22) Filed: Aug. 5, 2021

(51) Int. Cl.

| | |
|---|---|
| ***E04B 2/30*** | (2006.01) |
| ***F41H 5/24*** | (2006.01) |
| ***E04F 13/08*** | (2006.01) |
| ***F41H 5/013*** | (2006.01) |
| *E04F 13/16* | (2006.01) |
| *E04F 13/12* | (2006.01) |
| *E04F 13/14* | (2006.01) |

(52) U.S. Cl.
CPC ..... *F41H 5/24* (2013.01); *E04F 13/0803* (2013.01); *E04F 13/0866* (2013.01); *F41H 5/013* (2013.01); *E04F 13/12* (2013.01); *E04F 13/14* (2013.01); *E04F 13/16* (2013.01)

(58) Field of Classification Search
CPC ..... F41H 5/24; F41H 5/013
See application file for complete search history.

(56) References Cited

U.S. PATENT DOCUMENTS 4,558,552 A * 12/1985 Reitter, II ..... E04B 2/56 52/410
5,335,472 A * 8/1994 Phillips ..... E04C 3/44 D25/138
5,522,194 A * 6/1996 Graulich ..... E04C 2/26 52/309.4
5,811,719 A * 9/1998 Madden, Jr. ..... F41H 5/226 296/146.7
6,099,768 A * 8/2000 Strickland ..... E04C 2/06 264/46.7
6,112,489 A * 9/2000 Zweig ..... E04B 2/847 52/745.1
6,212,840 B1 * 4/2001 Davidovitz ..... E04H 9/10 52/506.01
6,298,766 B1 * 10/2001 Mor ..... E04H 9/06 89/36.01
6,543,371 B1 * 4/2003 Gardner ..... E04C 2/384 109/83
6,820,381 B1 * 11/2004 Ballough ..... E06B 9/02 248/48.1
7,458,305 B1 * 12/2008 Horlander ..... F41H 5/24 52/800.1
7,627,997 B2 * 12/2009 Messenger ..... E04C 2/06 52/794.1
7,694,621 B1 * 4/2010 Ma ..... F41H 5/013 89/36.02
8,151,687 B2 * 4/2012 Hall ..... E21D 11/00 52/309.1

(Continued)

*Primary Examiner* — Basil S Katcheves
(74) *Attorney, Agent, or Firm* — Ted Masters

(57) ABSTRACT

Apparatus for shielding a structure from bullets is disclosed. The structure includes an outside wall which has a vertical stud. The apparatus includes a prefabricated panel which has an armor plate having a front side and an opposite rear side. An exterior finish substructure is connected to the front side. After fabrication, the prefabricated panel is transported to the structure and connected to the vertical stud of the outside wall of the structure.

7 Claims, 7 Drawing Sheets

(56) References Cited

U.S. PATENT DOCUMENTS

| | | | | |
|---|---|---|---|---|
| 8,863,440 | B1 * | 10/2014 | Champlin | E05G 1/026 52/204.53 |
| 2003/0096072 | A1 * | 5/2003 | Johnson | E04G 9/06 428/137 |
| 2003/0159390 | A1 * | 8/2003 | Fonseca | E04B 1/26 52/506.01 |
| 2004/0123541 | A1 * | 7/2004 | Jewett | E04B 1/98 52/506.01 |
| 2006/0213360 | A1 * | 9/2006 | Ravid | F41H 5/0492 89/36.01 |
| 2007/0234895 | A1 * | 10/2007 | Singh | F41H 5/013 89/36.07 |
| 2008/0092730 | A1 * | 4/2008 | Hall | E21D 11/00 89/36.04 |
| 2010/0101404 | A1 * | 4/2010 | Lorenzo | E04H 9/10 89/36.04 |
| 2011/0072960 | A1 * | 3/2011 | Hallissy | F41H 1/02 73/35.14 |
| 2013/0233164 | A1 * | 9/2013 | Kestermont | E04B 1/10 52/220.8 |
| 2014/0224106 | A1 * | 8/2014 | Shackelford | F41H 5/0492 89/36.02 |
| 2015/0013922 | A1 * | 1/2015 | Pegrum | F41H 5/24 160/351 |
| 2017/0241749 | A1 * | 8/2017 | Boviall | F41H 5/026 |
| 2019/0194940 | A1 * | 6/2019 | Pyles | F41H 5/24 |

* cited by examiner

FIG. 1
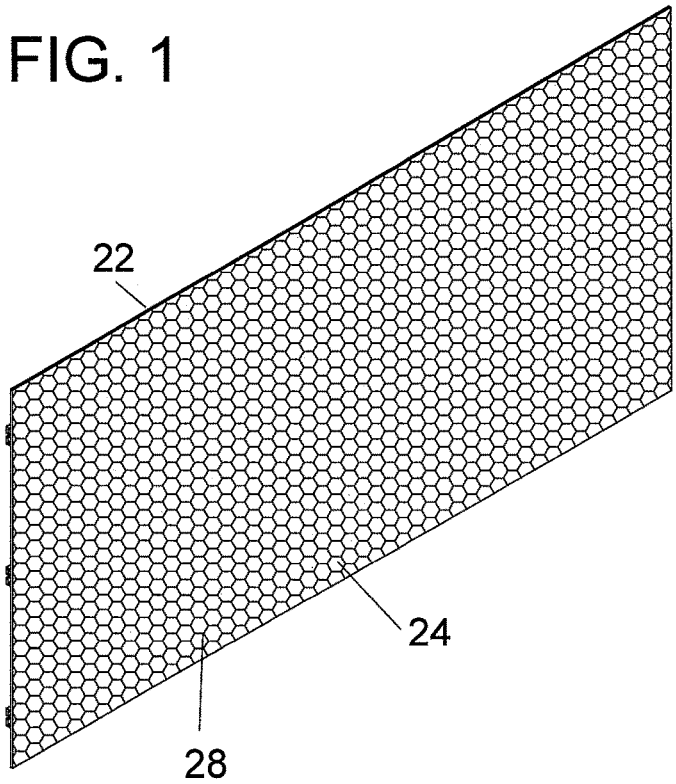
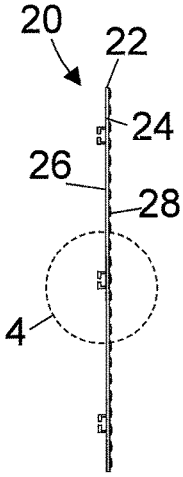
FIG. 3
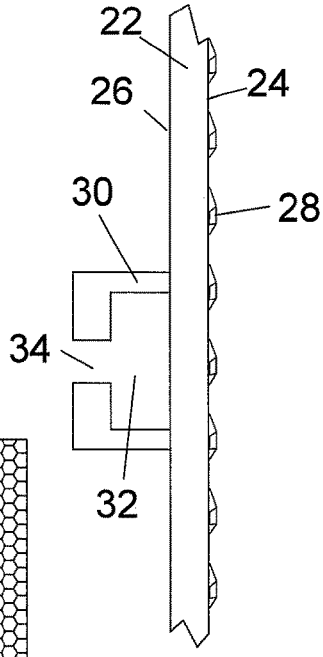
FIG. 4
FIG. 2
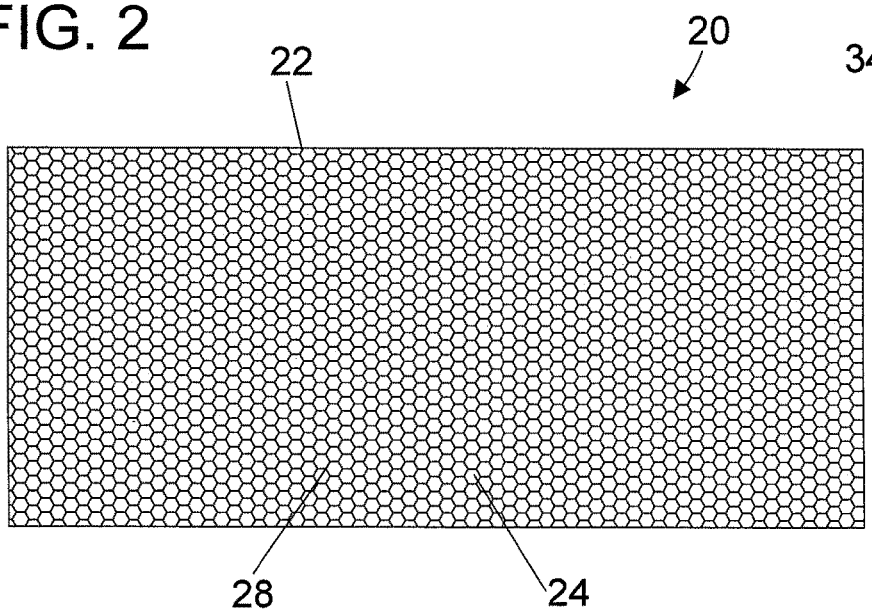

PRIOR
ART

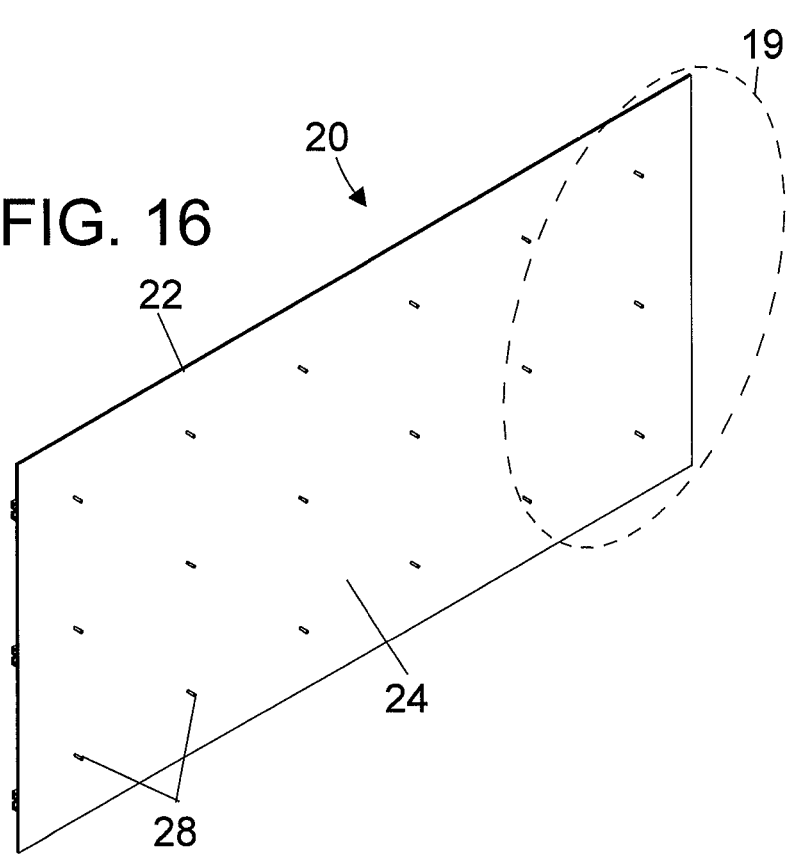
FIG. 16
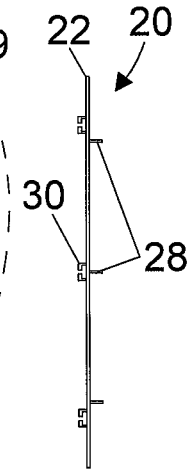
FIG. 17
FIG. 18
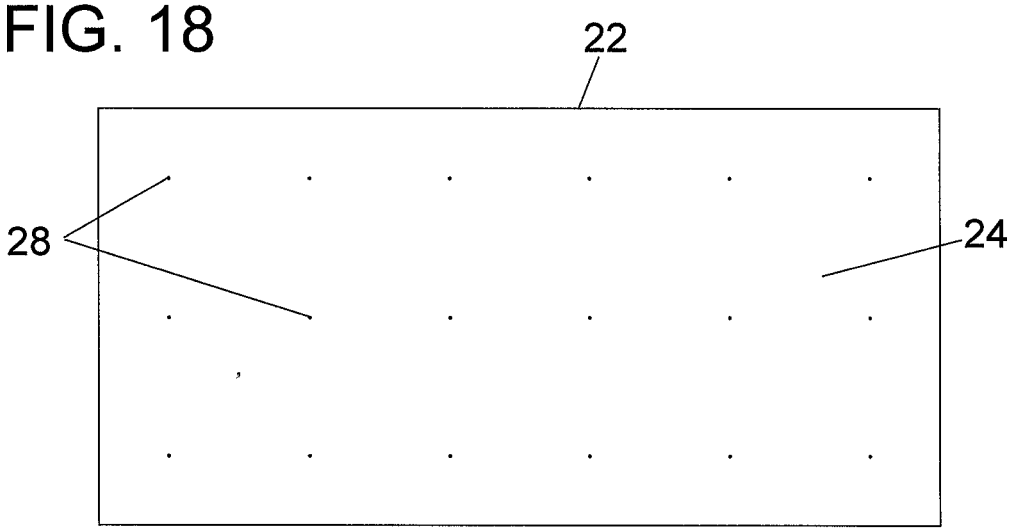

APPARATUS FOR SHIELDING A STRUCTURE FROM BULLETS AND METHOD OF USE

CROSS REFERENCE TO RELATED APPLICATION

None

TECHNICAL FIELD

The present invention pertains generally to building construction, and more particularly to an apparatus and method for protecting the occupants of a structure from external bullets or other projectiles.

BACKGROUND OF THE INVENTION

Gun violence is a ever increasing problem. Random and drive-by shootings are commonplace in today's society. Frequently bullets from shootings strike structures and penetrate the exterior wall, thereby presenting a danger to the occupants of the structure. Protecting the structure with bullet resistant armor plating can eliminate or substantially reduce the risk of structural damage and personal injury,

BRIEF SUMMARY OF THE INVENTION

The present invention is directed to apparatus and method for shielding a structure and its occupants from bullets, other projectiles, and explosive blasts. The apparatus includes prefabricated panels which are connected to the structure. The panels include an armor plate made of a bullet resistant material. An exterior finish substructure is connected to the armor plate, and the plate and substructure are connected to the structure as an integral unit. The prefabricated panels can be used with new construction structures or as a remodel retrofit.

In an embodiment, apparatus is provided for shielding a structure from bullets, the structure including an outside wall which has a vertical stud. The apparatus includes a prefabricated panel. The prefabricated panel includes an armor plate which has a front side and an opposite rear side. An exterior finish substructure is connected to the front side of the armor plate. The prefabricated panel is connectable to the vertical stud.

In accordance with another embodiment, the exterior finish substructure includes lath.

In accordance with another embodiment, the exterior finish substructure includes a plurality of outwardly extending studs.

In accordance with another embodiment, a horizontal track is disposed on the rear side of the armor plate.

In accordance with another embodiment, a connector is slidably received by the horizontal track. The connector is connectable to the vertical stud.

In accordance with another embodiment, the connector includes a rotating head which engages the horizontal track.

In accordance with another embodiment, the vertical stud has an inside surface. The connector is configured to engage the inside surface of the vertical stud.

Other embodiments, in addition to the embodiments enumerated above, will become apparent from the following detailed description, taken in conjunction with the accompanying drawings, which illustrate, by way of example, the principles of the apparatus for shielding a structure from bullets and method of use.

BRIEF DESCRIPTION OF THE DRAWINGS

FIG. 1 is a front perspective view of an apparatus for shielding a structure from bullets;

FIG. 2 is a side elevation view of the apparatus;

FIG. 3 is a front elevation view of the apparatus;

FIG. 4 is a view of area 4 of FIG. 3;

FIG. 16 is a front perspective view of a second embodiment of the apparatus;

FIG. 17 is a side elevation view of the second embodiment;

FIG. 18 is a front elevation view of the second embodiment;

DETAILED DESCRIPTION OF THE INVENTION

Figure 5:
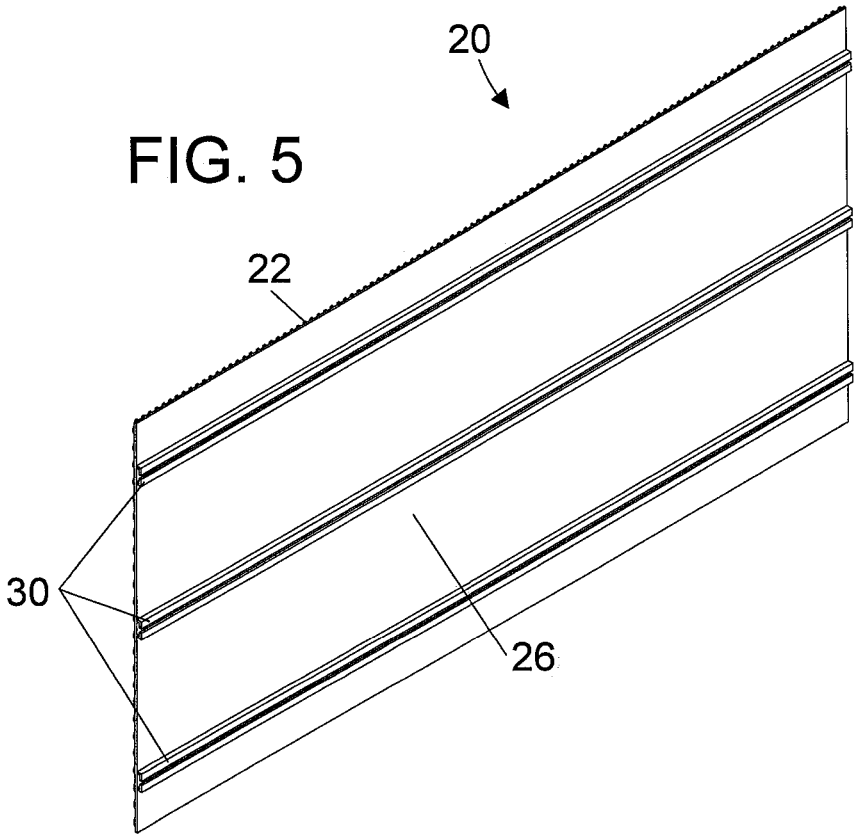
FIG. 5 is a rear perspective view of the apparatus.

Referring initially to FIGS. 1-6 there are illustrated various views of an apparatus for shielding a structure from bullets. Also referring to FIGS. 7 and 14, the structure is designated as 500, and has an outside wall 502 which has a vertical stud(s) 504. The apparatus includes a prefabricated panel 20 which includes an armor plate 22 having a front side 24 and an opposite rear side 26. Armor plate 22 is fabricated from a bullet resistant material such as steel, iron, other metal, ballistic concrete, synthetic fiber, or any other material which resists the penetration of bullets or other projectiles. In embodiments armor plate 22 is fabricated from AR500 or Mil-A-46100 material. The thickness of armor plate 22 can be varied as a function of the desired level of threat protection. For example, ⅛ inch for smaller caliber and lower velocity bullets, to ½ for larger caliber and higher velocity bullets.

Prefabricated panel 20 further includes an exterior finish substructure 28 which is connected to front side 24 of armor plate 22 to form an integral prefabricated panel 20 unit. Exterior finish substructure 28 is designed to serve as the foundation for an exterior finish 600 of structure 500 (refer to FIG. 15). The exterior finish substructure 28 can be of any form which is designed to receive any form of exterior finish 600. In the shown embodiment, exterior finish substructure 28 is wire mesh lath to which an exterior finish 600 of stucco (plaster) can be applied (refer also to FIG. 15 and the associated discussion). However other forms of exterior finish substructure 28 can also be utilized such as other forms of lath (wood, other metal lath, etc.), outwardly extending studs (refer to FIGS. 16-20 and the associated discussion), or any other substructure which can serve as a base for an exterior finish 600. The exterior finish substructure 28 can be welded, bolted, screwed, tied, or otherwise mechanically connected to armor plate 22.

Prefabricated panel 20 is connectable to vertical stud(s) 504 of outside wall 502 of structure 500 (refer to FIGS. 8-15 and the associated discussions).

As used herein the term "prefabricated panel" means that panel 20 is fabricated at an offsite manufacturing facility and transported to the site of structure 500 (the job site). That is, the exterior finish substructure 28 is not connected to armor plate 22 at the jobsite. The process typically includes (1) taking structure measurements at the structure 500, (2) fabricating prefabricated panel 20 to exactly fit a particular part of the structure 500, (3) transporting the prefabricated panel 20 to the structure 500, (4) connecting the prefabricated panel 20 to the structure 500 (also refer to FIGS. 14 and 15 and the associated discussions), and (5) connecting exterior finish 600 to prefabricated panel 20.

Figure 6:
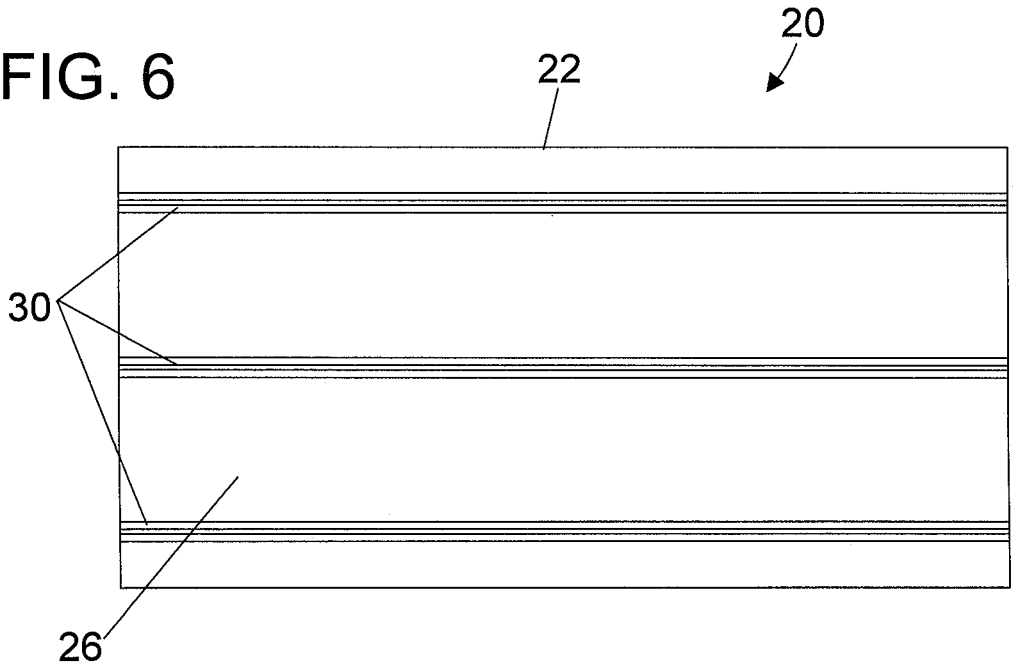
FIG. 6 is a rear elevation view of the apparatus.

Referring particularly to FIGS. 5 and 6, in an embodiment a horizontal track 30 is disposed on rear side 26 of armor plate 22, and extends from one side of armor plate 22 to the other side. In the shown embodiment three horizontal tracks 30 are utilized. Referring to FIG. 4, horizontal track 30 includes a cavity 32 and an opening 34. Horizontal track 30 is configured to slidably receive a connector(s) 38 which connects prefabricated panel 20 to vertical studs 504 of outside wall 502 (refer to FIGS. 7-13 and the associated discussions).

Figure 7:
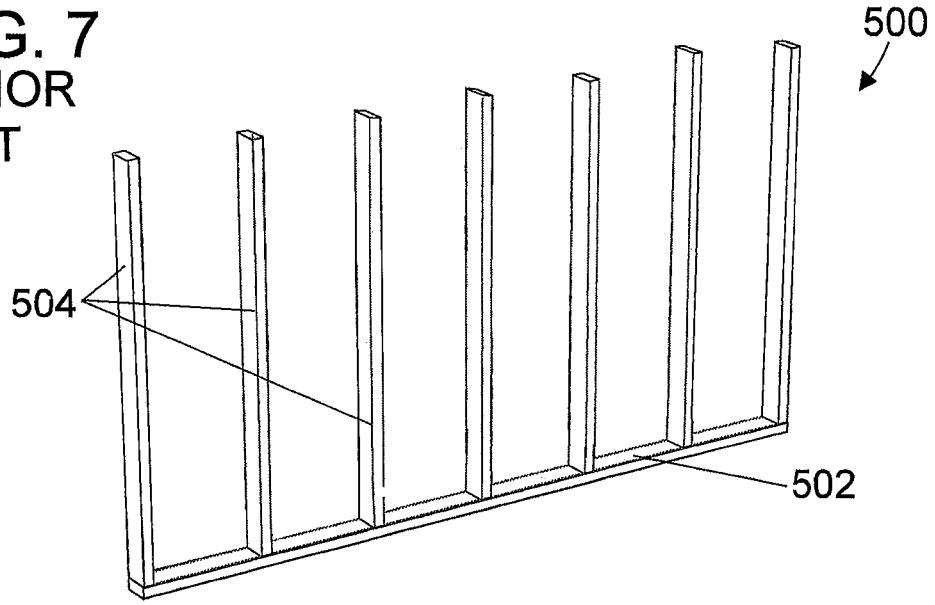
FIG. 7 is a rear perspective view of a prior art structure which includes an outside wall which has a plurality of upstanding studs.
Figure 8:
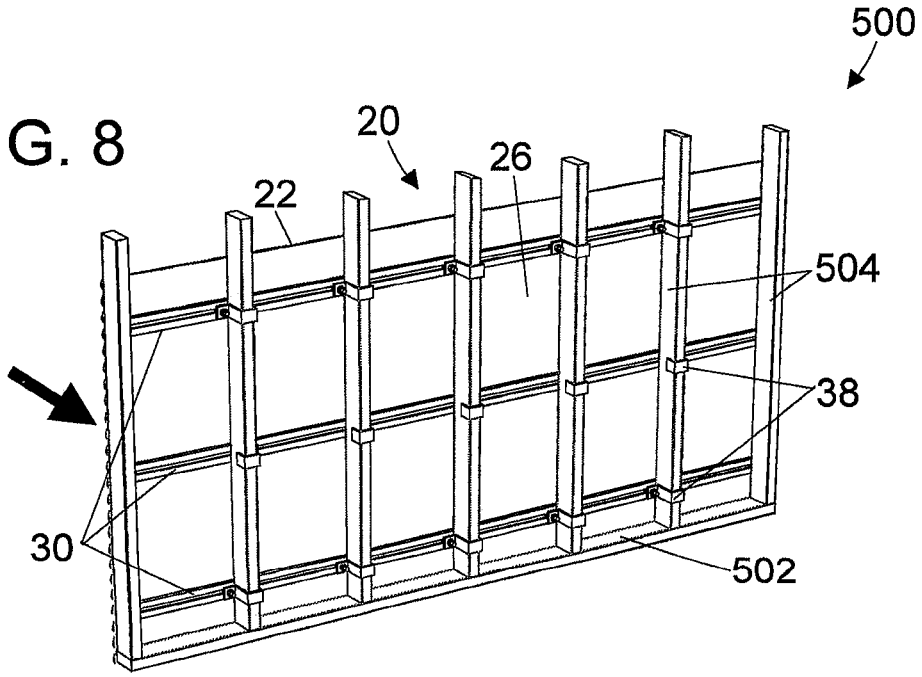
FIG. 8 is a rear perspective view of the apparatus connected to the structure of FIG. 7.

FIG. 7 is a rear perspective view of a prior art structure 500 which includes an outside wall 504 which has a plurality of upstanding studs 502. FIG. 8 is a perspective view of prefabricated panel 20 connected to the upstanding studs 504 of the structure 500 of FIG. 7. In FIG. 8 prefabricated panel 20 has been connected to vertical studs 504 of outside wall 502 of structure 500. In the shown embodiment the connection is effected by a plurality of connectors 38 which are connected to vertical studs 504 and which are slidably received by horizontal track 30.

Figure 9:
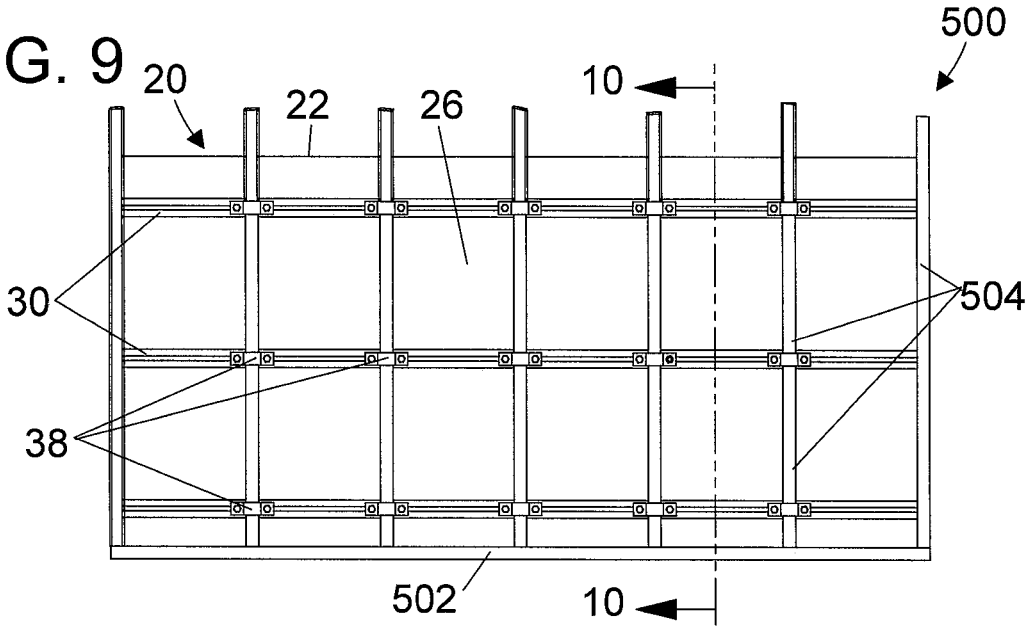
FIG. 9 is a rear elevation view of FIG. 8.
Figure 10:
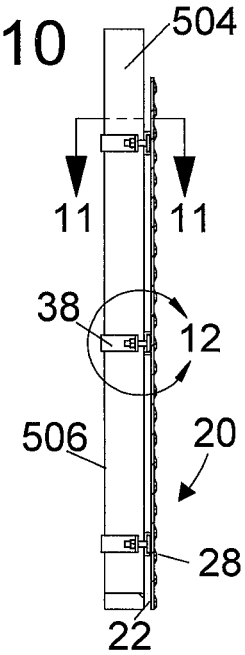
FIG. 10 is a sectional view along the line 10-10 of FIG. 9.
Figure 11:
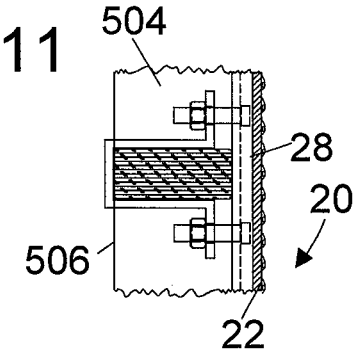
FIG. 11 is a sectional view along the line 11-11 of FIG. 10.
Figure 12:
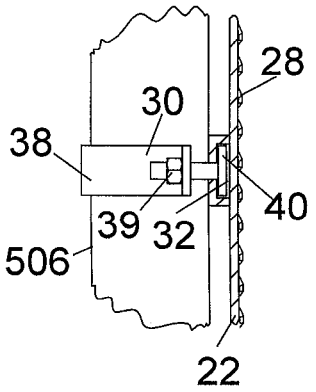
FIG. 12 is a sectional view along the line 12-12 of FIG. 11.
Figure 13:
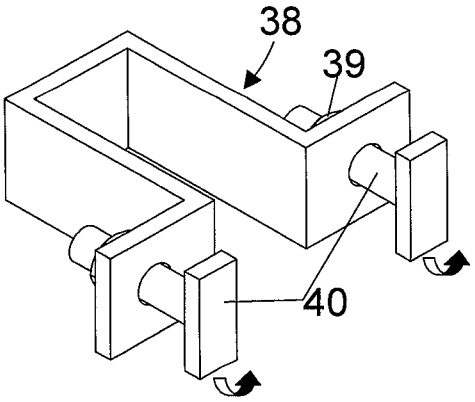
FIG. 13 is an enlarged perspective view of a connector.

FIG. 9 is a rear elevation view of FIG. 8, FIG. 10 is a sectional view along the line 10-10 of FIG. 9, FIG. 11 is a sectional view along the line 11-11 of FIG. 10, FIG. 12 is a sectional view along the line 12-12 of FIG. 11, and FIG. 13 is an enlarged perspective view of connector 38. In the shown embodiment, connectors 38 wrap abound the inside surface 506 of vertical studs 504 and include nuts 39 which are used to pull prefabricated panel 20 toward vertical studs 504. Connectors 38 further includes a rotating head(s) 40 which slidably engages cavity 32 of horizontal tracks 30. Rotating heads 40 are rotatable (as shown by arrows 44) so that they can fit into cavity 32 via opening 34, and then rotate about 90° to lock in place within cavity 32 (also refer to FIG. 4).

Figure 14:
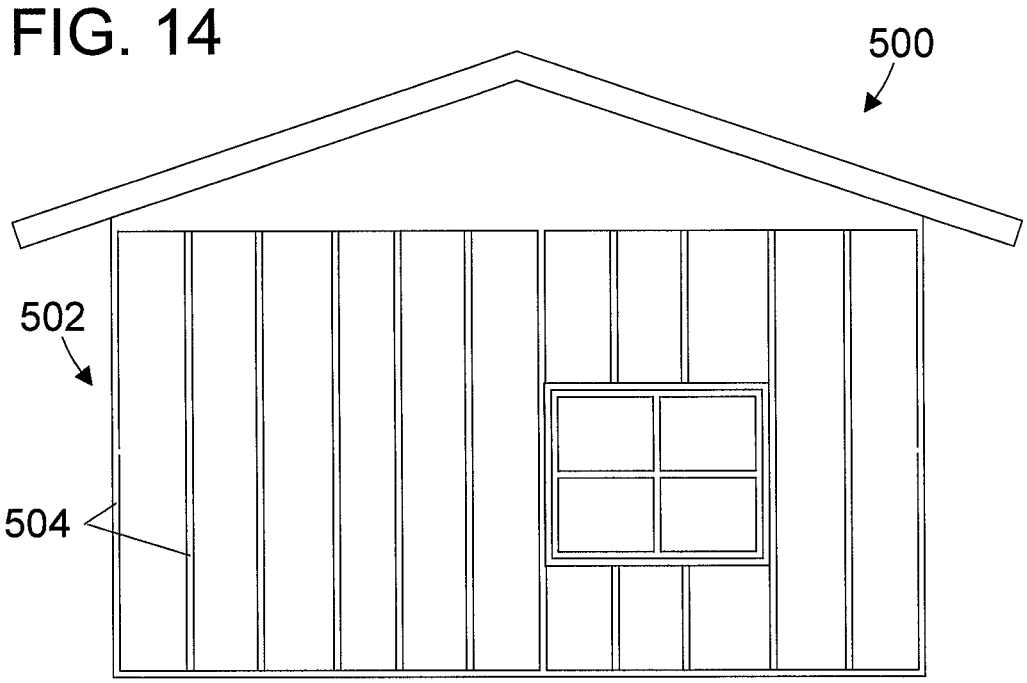
FIG. 14 is a reduced front elevation view of a structure.

FIG. 14 is a reduced front elevation view of prior art structure 500. Structure 500 includes an outer wall 502 which has a plurality of upstanding vertical studs 504. In this embodiment, structure 500 is newly built.

Figure 15:
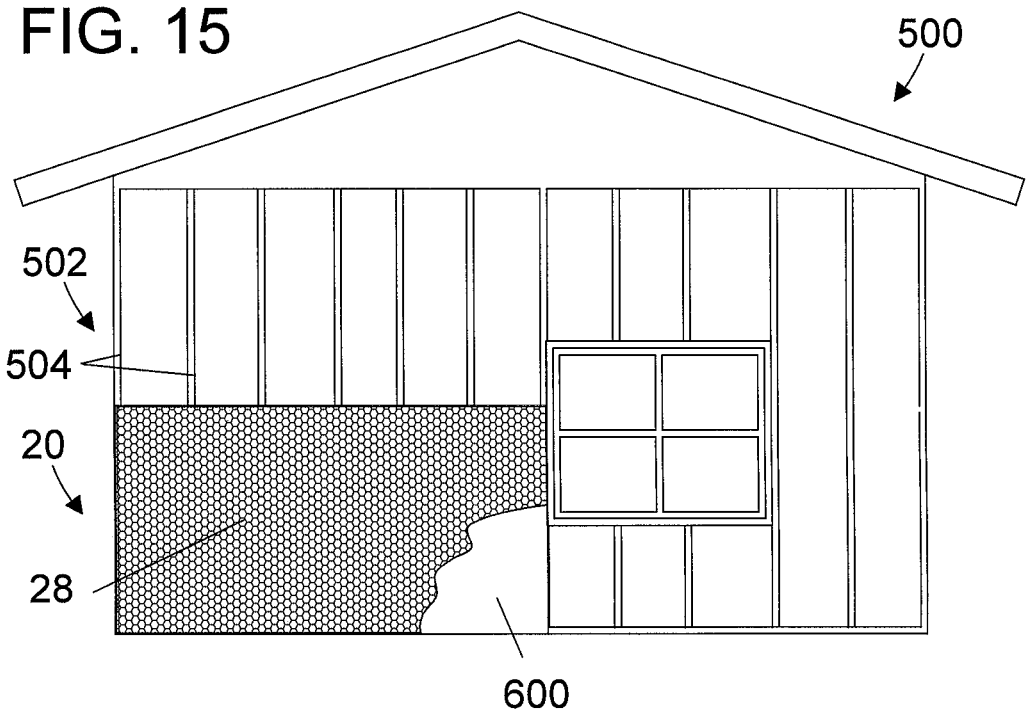
FIG. 15 is a reduced front elevation view of the apparatus connected to the structure.
Figure 19:
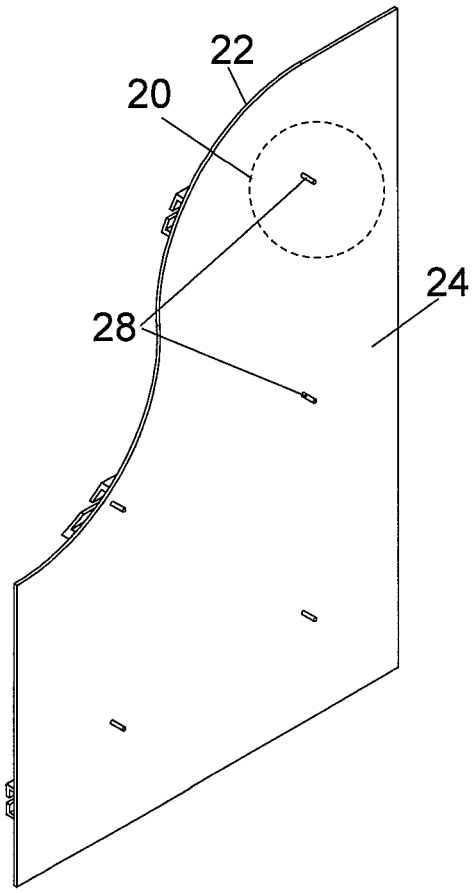
FIG. 19 is an enlarged view of area 19 of FIG. 16.
Figure 20:
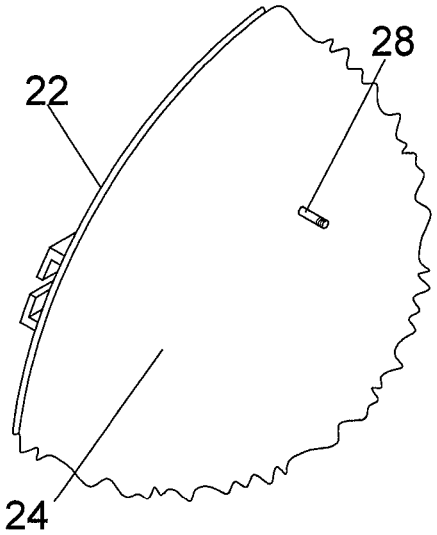
FIG. 20 is an enlarged view of area 20 of FIG. 19.

FIG. 15 is a reduced front elevation view of the apparatus connected to structure 500. Prefabricated panel 20 is connected to vertical studs 504 with connectors 38 as described above. It may be appreciated however that prefabricated panel 20 can also be connected to vertical studs by other means such as by screws, bolts, or other mechanical connection means. Connection by bolts or screws from the outside can be advantageous when prefabricated panels 20 are being installed as a retrofit to an existing (not new build) structure 500. By so doing the inside surface of the outside walls 502 do not have to be penetrated to install the shown connectors 38. It is noted that in the shown embodiment an exterior finish of stucco has been applied to a portion of prefabricated panel 20.

FIGS. 16-20 are various views of a second embodiment of the apparatus. In this embodiment exterior finish substructure 28 of prefabricated panel 20 includes a plurality of outwardly extending studs which are connected to front side 24 of armor plate 22. The studs serve as an anchor point for an exterior finish of a planar material such as plywood to which siding or another exterior finish 600 is attached. In an embodiment the studs are threaded (refer to FIG. 20). The second embodiment also includes horizontal tracks 30.

In an embodiment, prefabricated armor panel 20 is combined with structure 500 to form a bullet resistant system.

In terms of use, a method of providing bullet resistance includes:

(a) providing a structure 500 including an outside wall 504 which has a vertical stud 504;

(b) providing a prefabricated panel 20 including;

an armor plate 22 having a front side 24 and an opposite rear side 26;

an exterior finish substructure 28 connected to the front side 24;

(c) providing an exterior finish 600;

(d) connecting the prefabricated panel 20 to the vertical stud 504; and, (e) connecting the exterior finish 600 to the exterior finish substructure 28.

The method further including:

providing an offsite manufacturing facility;

before (b), measuring the structure 500 and calculating a required size of the prefabricated panel 20;

manufacturing the required size prefabricated panel 20 at the manufacturing facility; and, before (d) transporting the prefabricated panel 20 from the manufacturing facility to the structure 500.

The method further including:

in (b), the exterior finish substructure 28 including lath.

The method further including:

the exterior finish substructure 28 including a plurality of outwardly extending studs.

The embodiments of the apparatus for shielding a structure from bullets and method of use described herein are exemplary and numerous modifications, combinations, variations, and rearrangements can be readily envisioned to achieve an equivalent result, all of which are intended to be embraced within the scope of the appended claims. Further, nothing in the above-provided discussions of the apparatus and method should be construed as limiting the invention to a particular embodiment or combination of embodiments. The scope of the invention is defined by the appended claims.

I claim:

1. Apparatus for shielding a structure from bullets, the structure including an outside wall which has a vertical stud, the apparatus comprising:

a prefabricated panel including;

an armor plate having a front side and an opposite rear side;

an exterior finish substructure connected to said front side;

said prefabricated panel connectable to the vertical stud;

a horizontal track disposed on said rear side of said armor plate;

a connector which is slidably received by said horizontal track; and, said connector connectable to the vertical stud.

2. The apparatus according to claim 1, further including:
said connector including a rotating head which engages said horizontal track.

3. The apparatus according to claim 1, the vertical stud having an inside surface, the apparatus further including:
said connector configured to engage the inside surface of the vertical stud.

4. Apparatus for shielding a structure from bullets, the structure including an outside wall which has a vertical stud, the vertical stud having an inside surface, the apparatus comprising:
a prefabricated panel including;
an armor plate having a front side and an opposite rear side;
an exterior finish substructure connected to said front side;
said prefabricated panel connectable to the vertical stud;
a horizontal track disposed on said rear side of said armor plate;
a connector which is slidably received by said horizontal track;
said connector including a rotating head which engages said horizontal track; and,
said connector configured to engage the inside surface of the vertical stud.

5. A bullet resistant system, comprising:
a structure including an outside wall which has a vertical stud;
a prefabricated panel including;
an armor plate having a front side and an opposite rear side;
an exterior finish substructure connected to said front side;
said prefabricated panel connectable to said vertical stud;
a horizontal track disposed on said rear side of said armor plate;
a connector which is slidably received by said horizontal track; and,
said connector connectable to a said vertical stud.

6. The system according to claim 5, further including:
said connector including a rotating head which engages said horizontal track.

7. The system according to claim 5, further including:
said vertical stud having an inside surface;
said connector configured to engage said inside surface of said vertical stud.

* * * * *